United States Patent [19]

Donadio

[11] 3,938,442

[45] Feb. 17, 1976

[54] SERRATED SUPPORTING KEYING SYSTEM FOR A BEEHIVE PROJECTILE

[75] Inventor: Vincent J. Donadio, Pompton Plains, N.J.

[73] Assignee: The United States of America as represented by the Secretary of the Army, Washington, D.C.

[22] Filed: Sept. 27, 1971

[21] Appl. No.: 183,888

[52] U.S. Cl. ..... 102/67; 102/93; 102/DIG. 7

[51] Int. Cl.[2] ..... F42B 13/48

[58] Field of Search ..... 102/DIG. 7, 67, 93

[56] References Cited

UNITED STATES PATENTS

| | | | |
|---|---|---|---|
| 1,195,107 | 8/1916 | Sheriff | 102/DIG. 7 |
| 3,111,902 | 11/1963 | Taylor | 102/DIG. 7 |
| 3,444,813 | 5/1969 | Bird | 102/93 |
| 3,738,279 | 6/1973 | Eyre et al. | 102/DIG. 7 |

*Primary Examiner*—Maynard R. Wilbur
*Assistant Examiner*—G. E. Montone
*Attorney, Agent, or Firm*—Nathan Edelberg; Robert P. Gibson; A. Victor Erkkila

[57] ABSTRACT

A keying system for interlocking the components of a beehive type projectile by set back force generated by firing of the projectile. Tubular spacing members having smooth rims are engraved by a pre-engraved plate upon the set back force to prevent rotation of the components and the pay load during trajectory of the projectile.

13 Claims, 6 Drawing Figures

INVENTOR,
Vincent J. Donadio

BY: Harry M. Saragovitz, Edward J. Kelly & Herbert Berl
a. Victor Erkkila ATTORNEYS.

INVENTOR.
VINCENT J. DONADIO
BY Harry M. Saragovitz, Edward J. Kelly, Herbert Berl & Vincent Ertkein

SERRATED SUPPORTING KEYING SYSTEM FOR A BEEHIVE PROJECTILE

The invention described herein may be manufactured, used, and licensed by or for the Government for governmental purposes without the payment to me of any royalty thereon.

BACKGROUND

Projectiles of the beehive type consist of a shell in which the pay load, such as flechettes is divided into a number of axially aligned bays. The aforesaid pay load assembly must not rotate when the shell is spinning during its trajectory towards a target, else the balance of the shell is destroyed and tumbling will result in subsequent malfunction of its mission. An existing method consisted of pre-engraving both the spacer and the dividing plate of each of the number of bays in the projectile. This method entailed costly machining and was time consuming as well.

SUMMARY

The present invention provides for the engraving of the rims of the spacer members by the support, or dividing plate, which is provided with at least one serrated face. The support plates are non-rotatable or rotatable and upon set back force, the serrations engrave the rim of the spacer and interlock the components. This results in uniformly matched surfaces, ability to react higher loads, and reduced costs by virtue of the elimination of additional machining or forming processes for the projectile components. It is therefore a principal object of this invention to provide a simpler method of interlocking the components used to support and protect axially aligned bays of flechettes in a projectile.

DETAILED DESCRIPTION

Figure 1:
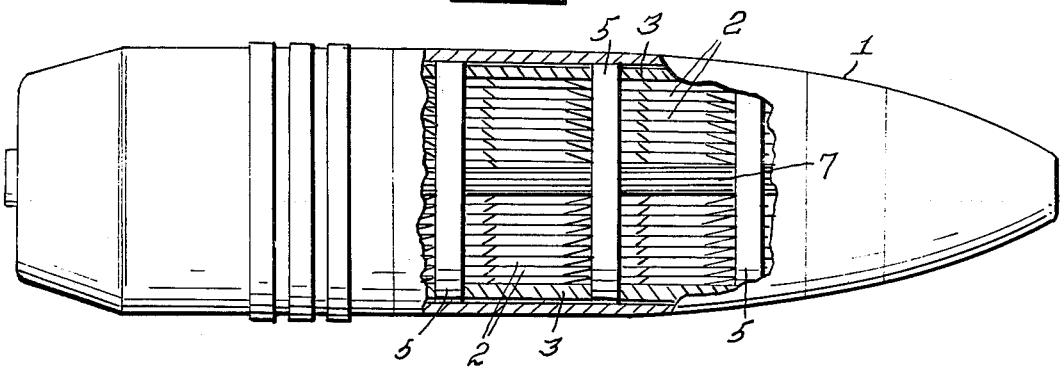
FIG. 1 is a side elevation of a projectile partly broken away to expose the position of the components of the invention.
Figure 2:
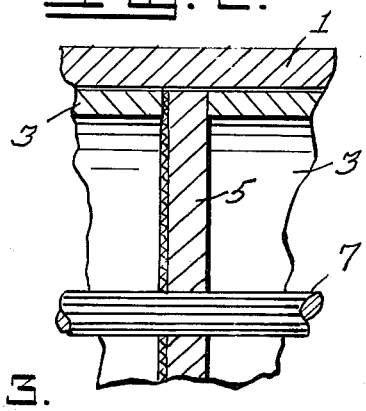
FIG. 2 is a fragmentary detailed view in section, and greatly enlarged to illustrate the components before engraving.

Referring in detail to the drawing and particularly to FIG. 1 wherein reference character 1 indicates a projectile of the beehive type in which the pay load of the projectile is divided into axially aligned compartments, or bays. As seen in FIG. 1, the pay load is flechettes 2. Each bay is housed in a tubular spacer 3 having a flush rim 4. Only two complete bays are shown, but it is obvious that the number of bays will be varied according to the length of the projectile. Each spacer 3 is separated from the adjacent spacer by a support plate 5 which consists of a disc having a ring of serrations 6 adapted to mate with the rim 4 of the spacer 3. Each disc 5 is so mounted to be non-rotatable in the projectile 1. Any method will suffice and one such method may consist of a splined shaft 7 mounted axially in the projectile 1. Shaft 7 passes through a splined axial bore 8 in each disc 5 so that the disc, or discs may slide but not rotate, with the ring of serrations 6 facing the smooth rim 4 of a spacer 3, other bays being arranged in the same manner so that upon set back forces will transmit torque at each bay level.

When projectile 1 is fired from a weapon, not shown, the set back force occurring will cause support plates 5 fabricated of relatively hard material; e.g., steel, to be driven rearwardly so that serrations 6 on the plates 5 will engrave the smooth rims 4 of the spacers 3 fabricated of relatively soft material; e.g., aluminum, copper or brass, as at 9 and lock the entire assembly while projectile 1 is spinning. Thus, the assembly is locked together to enable transmission of torque and compressive loading to all components of the projectile to provide gyroscopic stability. The geometry of the serrations 6 is not critical since any rough surface on the support plate 5 would suffice, such as abrasive particles, etc. The surface area of rim 4 of the spacer may be adjusted, e.g., chamfered, to control the bearing area and hence the depth of engraving.

While only one rim of the spacer 3 is shown to be engraved, it is apparent that if support plate 5 were provided with serrations on both faces, it would be possible to engrave the leading rim of one spacer as well as the rearward rim of another.

Figure 3:
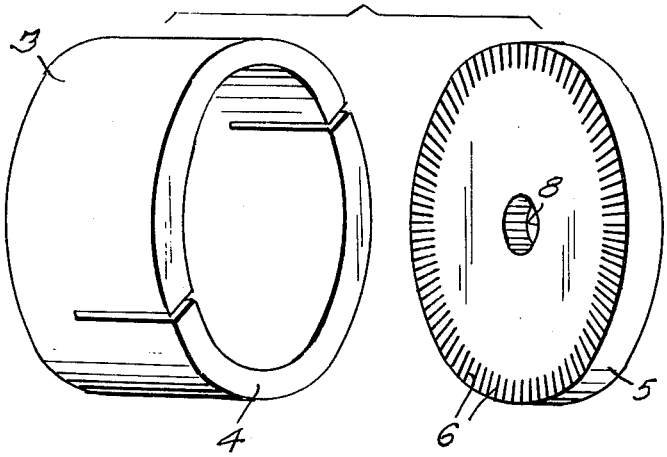
FIG. 3 is an exploded perspective view of a spacing member and a support plate, the rim of the spacer shown before set back force.
Figure 4:
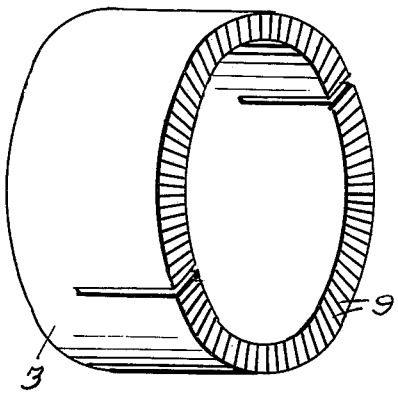
FIG. 4 is a perspective view of the spacing element showing the rim as engraved after set back force.
Figure 5:
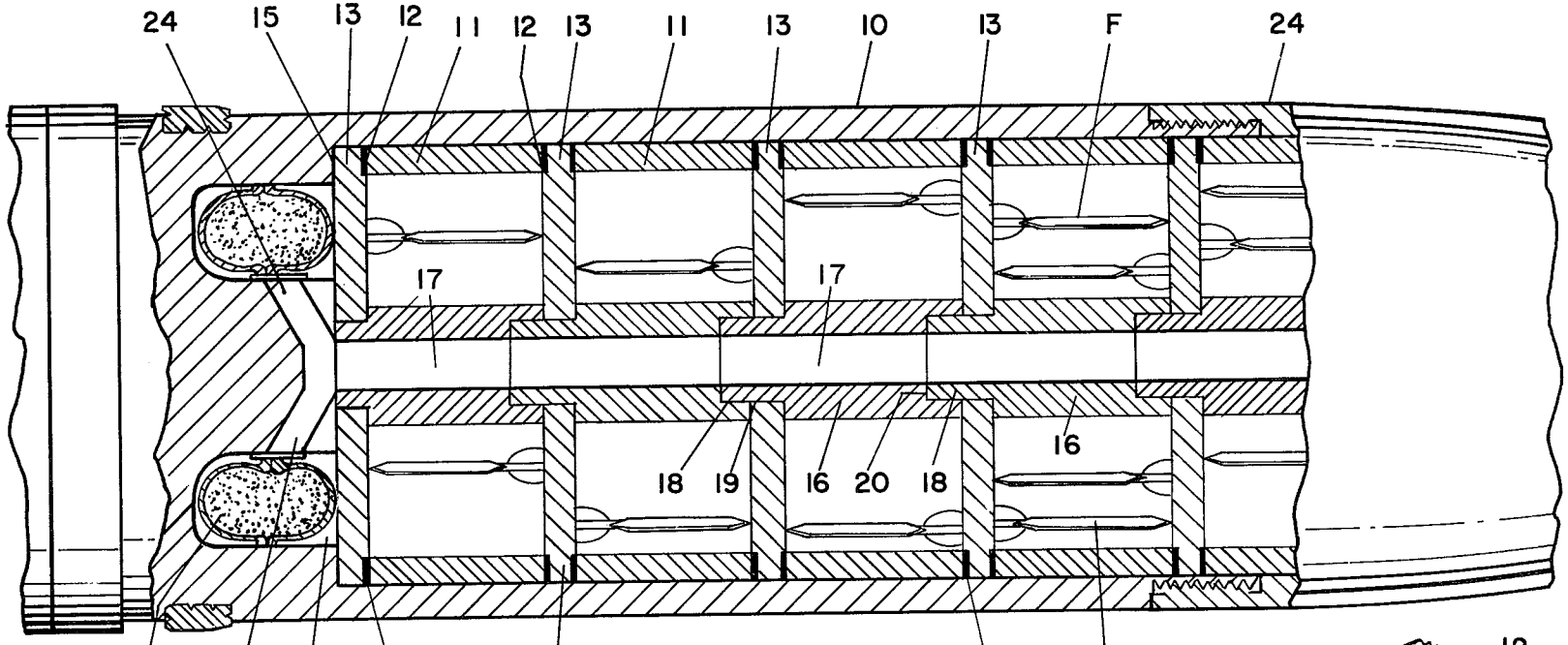
FIG. 5 is a side elevation of another projectile partly broken away to expose the position of the components of the invention.
Figure 6:
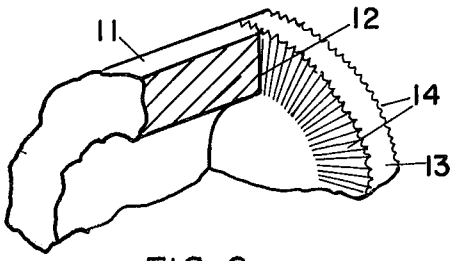
FIG. 6 is a fragmentary perspective view in section of FIG. 5, enlarged to illustrate the components after engraving.

FIG. 5 illustrates a projectile of the beehive type 10, wherein the payload of flechettes (shown in part by letter F) is contained in a series of axially aligned bays only four of which are completely shown, and wherein non-rotation of the load components within the projectile is accomplished without the use of the splined shaft or other means for non-rotatably mounting the support plates in the projectile. As seen in FIG. 5, each bay is housed in a tubular spacer 11 having flush rims 12 similar to that shown in FIG. 3. Each spacer 11 is separated from an adjacent spacer by a support plate 13, which consists of a disc having a ring of serrations 14 on both faces, each mating with a rim 12 of spacer 11, as shown in detail in FIG. 6. The first support plate 13 is positioned on an annular shoulder or shelf 15 at the base and integral with the housing of the projectile 10, and is followed by a spacer 11. Succeeding support plates 13 are positioned between pairs of spacers 11. An inner spacer 16 of cylindrical shape and having an axially aligned center hole 17 is inserted between pairs of support plates 13, if necessary, to prevent deformation of the plates by the load pressure generated by the set back force occurring when the projectile is fired. Each inner spacer 16 at one end has an extension 18 of smaller diameter, which is inserted through a center hole 19 in support plate 13, and a cavity 20 at the other end, which receives the extension 18 of the succeeding inner spacer 16. The extension 18 of the first inner spacer 16 does not project beyond the rear face of the first support plate 13. Sufficient clearance between support plates 13 and inner spacers 16 is provided to permit engraving of rims 12 of spacers 11 and annular shelf 15 by the serrations on the support plates 13. The base of the projectile possesses an annular cavity 21 which contains a propellant charge 22 in a plastic bag. Channels 23 and 24 communicate with center hole 17 of inner spacers 16 and annular cavity 21.

When the projectile 10 is fired from a weapon (not shown), the resulting set back force drives the support plates 13 rearwardly, whereby the serrations 14 on the first support plate 13 engrave the annular shelf 15 and rearward rim of adjacent spacer 11, and the serrations 14 on succeeding support plates 13 engrave the leading the rearward rims 12, resp. of each pair of adjacent spacers 13, thereby interlocking the spacers, support plates and projectile. When the projectile reaches the target area, a fuze initiates a detonator train therein (not shown), which ruptures the ogive 24 (shown in part) and sends a flash through the passage formed by center holes 17 and channels 23 and 24 to annular cavity 21 containing propellant charge 22, which ignites and expels the pay load of flechettes F.

The arrangement and embodiment of the invention shown in FIG. 5 is preferred, since (1) it obviates use of the aforementioned splined shaft with its attendant additional machining operations, (2) it is stronger as it distributes the torque over a larger radius, which is important in large caliber projectiles, e.g., 105 mm and larger, and (3) it permits greater capacity of flechettes in each bay level.

The arrangement shown in FIG. 5 may be modified such that support plates serrated on both the forward and rearward faces may be placed, one each, between a pair of spacers in combination with a first support plate, which has serrations only on its forward face and is initially locked to the projectile by conventional keying means, e.g. square keys, pins and screws.

It is obvious that combinations of support plates serrated on one or both faces (rearward or forward) can be employed to obtain interlocking of spacers and support plates, which latter can be locked to the projectile by suitable keying means. Thus, support plates serrated on one or both faces and provided with means for locking same to the projectile, as illustrated above, can be alternated with spacers so that at least one serrated face of each supporting plate is in contact with and capable of engraving a rim of each spacer. The invention contemplates initially locking one or more of the support plates to the projectile by conventional keying means, e.g. splined shaft, and/or effecting the locking by setback force which causes the support plates to engrave the projectile as well as the spacers, as illustrated above, the arrangement being so selected that interlocking of all spacers and support plates and projectile is accomplished when the projectile is fired.

I wish it to be understood that I do not desire to be limited to the exact method and detail of construction described for obvious modification will occur to persons skilled in the art.

What is claimed is:

1. In combination with a spin-stabilized projectile including a divided payload; a keying system for said payload comprising a series of axially aligned spacing members, each said spacing member housing a portion of said payload, a series of axially aligned supporting members disposed, one each, between a pair of said spacing members, engraving means on at least one end of each said supporting member, at least one end with engraving means being in contact with each spacer, and means for locking said supporting members to the projectile, whereby setback force generated by firing of said projectile causes said supporting members to engrave the ends of said spacing members and interlock said divided payload against rotational movement during projectile spin.

2. A system as set forth in claim 1 wherein each said spacing member comprises a tubular housing having at least one flush rim.

3. A system as set forth in claim 1 wherein each said supporting member comprises a disc and a ring of serrations carried by at least one side of said disc.

4. A system as set forth in claim 1 wherein said locking means permits slidable movement of said supporting members in said projectile, and each said supporting member carries engraving means on the rearward end thereof, whereby set back force generated by firing of said projectile drive said supporting members rearwardly to engrave the forward ends of said spacing members and interlock said divided pay load to prevent rotation thereof during spin of said projectile in its trajectory.

5. A system as set forth in claim 4 wherein said means for locking said supporting members comprises a splined shaft mounted axially in said projectile and passing axially through said supporting members, whereby said supporting members are mounted in a slidable and non-rotating manner thereon.

6. A system as set forth in claim 1, wherein the first supporting member carries engraving means on its forward end and is disposed between the base of the projectile and the first spacing member, and each of the other supporting members has engraving means on both forward and rearward ends, at least the first supporting member being non-rotatably mounted in the projectile, whereby setback force generated by firing of the projectile causes said supporting members to engrave the ends of said spacing members and interlock said divided payload to prevent rotation thereof in the projectile during projectile spin.

7. In combination with a spin-stabilized projectile including a divided payload; a keying system for said payload comprising a series of axially aligned spacing members, each said spacing member housing a portion of said payload, a series of axially aligned supporting members disposed, one each, between a pair of said spacing members and one between the base of said projectile and the first of said spacing members, and engraving means carried by both the forward and rearward ends of each said spacing member, whereby setback force generated by firing of said projectile causes said supporting members to engrave the ends of said spacing members and the base of said projectile and interlock said divided payload to prevent rotation thereof in the projectile during projectile spin.

8. A projectile according to claim 7 wherein each said supporting member comprises a disc and a ring of serrations carried by both sides of said disc.

9. A projectile as claimed in claim 8, wherein each said spacing member comprises a tubular housing having flush rims and the base of the projectile has an annular shelf with a smooth rim in contact with said first spacing member.

10. A projectile according to claim 9, wherein said ring of serrations on each disc is equivalent in diameter to said smooth rims of said housings and said annular shelf.

11. A beehive projectile comprising a plurality of axially aligned housings therein, a plurality of flechettes carried by each said housing, each said housing having smooth forward and rearward rims, a plurality of discs disposed, one each, between each pair of housings, and one between the base of the projectile and the first of said housings, a ring of serrations on both forward and rearward faces of each said discs, and an annular shelf having a smooth rim on the base of said projectile, whereby when said projectile is fired, setback force generated thereby will engrave said smooth rims on said housings and on said annular shelf on the base of the projectile and interlock said housings against rotational movement during projectile spin.

12. A projectile as claimed in claim 11 wherein said ring of serrations on each said disc is equivalent in diameter to said smooth rims of said housings and projectile base.

13. A beehive projectile comprising a plurality of axially aligned housings therein, a splined shaft mounted axially in said projectile, a plurality of flechettes carried by each said housing, each said housing having a flush forward rim, a plurality of discs slidably mounted on said shaft, said discs being disposed, one each, between a pair of housings and a ring of serrations on the rearward face of each said discs, whereby when said projectile is fired, setback force generated thereby will drive said discs rearward to engrave said smooth rims on said housings and interlock said housings against rotational movement during projectile spin.

* * * * *